US006212979B1

(12) United States Patent
Wang

(10) Patent No.: US 6,212,979 B1
(45) Date of Patent: Apr. 10, 2001

(54) ANTI-SLIDE COVERS FOR TOGGLE OPERATED PLIERS

(76) Inventor: Pang-Chung Wang, P.O. Box 63-247, Taichung (TW)

( * ) Notice: Subject to any disclaimer, the term of this patent is extended or adjusted under 35 U.S.C. 154(b) by 0 days.

(21) Appl. No.: 09/393,197

(22) Filed: Sep. 9, 1999

(51) Int. Cl.[7] ..... B25B 7/00
(52) U.S. Cl. ..... 81/427.5; 30/340
(58) Field of Search ..... 81/427.5, 177.1, 81/489; 30/340

(56) References Cited

U.S. PATENT DOCUMENTS

| | | | | |
|---|---|---|---|---|
| 1,096,602 | * | 5/1914 | Coles | 30/340 |
| 2,520,355 | * | 8/1950 | Bell | 30/340 |
| 4,811,637 | * | 3/1989 | McCleary | 81/177.2 |
| 4,942,791 | * | 7/1990 | Stewart et al. | 81/177.1 |
| 5,216,780 | * | 6/1993 | Lutzke et al. | 16/111 R |
| 5,823,077 | * | 10/1998 | Macor | 81/177.1 |
| 5,910,174 | * | 6/1999 | Finn | 7/127 |

FOREIGN PATENT DOCUMENTS

| | | | | |
|---|---|---|---|---|
| 391016 | * | 2/1924 | (DE) | 81/427.5 |
| 125723 | * | 2/1961 | (FR) | 81/177.1 |
| 641521 | * | 6/1962 | (IT) | 81/427.5 |

* cited by examiner

*Primary Examiner*—James G. Smith
*Assistant Examiner*—Hadi Shakeri
(74) *Attorney, Agent, or Firm*—Alan Kamrath; Rider Bennett Egan & Arundel, LLP.

(57) ABSTRACT

A pair of toggle operated pliers includes a first handle with an adjusting screw attached thereto, a second handle, a toggle link pivotally connected between the first handle and the second handle, and a release lever having an end pivotally connected to the second handle by a first pin. The first pin includes two first exposed enlarged ends. The toggle link includes an end pivotally connected to the second handle by a second pin. The second pin includes two second exposed enlarged ends. A first anti-slide cover is detachably attached to the first handle and includes a first compartment for fittingly embracing a portion of the first handle. The first anti-slide cover is prevented from disengaging from the first handle by a head of the adjusting screw. A second anti-slide cover is detachably attached to the second handle and includes a second compartment for fittingly embracing a portion of the second handle. The second anti-slide cover includes two side walls each having a first depression for releasably engaging with an associated first exposed enlarged end and a second depression for releasably engaging with an associated second exposed enlarged end.

8 Claims, 3 Drawing Sheets

ANTI-SLIDE COVERS FOR TOGGLE OPERATED PLIERS

BACKGROUND OF THE INVENTION

1. Field of the Invention

The present invention relates to anti-slide covers for toggle operated pliers.

2. Description of the Related Art

Pliers are often provided with plastic covers on the handles thereof to avoid slippage when clamping an object between the jaws of the pliers. The plastic covers are generally formed by means of immersing the handles of the pliers in a liquid bath. The liquid hardens and thus forms an anti-slip layer on each metal handle. Nevertheless, such a process cannot be used on toggle lever operated pliers (e.g., toggle lever operated pliers disclosed in U.S. Pat. No. 2,478,696 to Isele issued on Aug. 9, 1949 and in U.S. Pat. No. 2,592,803 to Heim issued on Apr. 15, 1952), as the plastic cover will cause malfunction of the toggle link and other movable elements. Thus, the user has to firmly hold the pliers to prevent the pliers from slipping through the hands. This causes operational inconvenience.

The present invention is intended to provide anti-slide covers that mitigate and/or obviate the above problems.

SUMMARY OF THE INVENTION

In accordance with a first aspect of the invention, an anti-slide cover is provided for a pair of toggle operated pliers of the type including a first handle with an adjusting screw attached thereto, a second handle, and a toggle link pivotally connected between the first handle and the second handle. The anti-slide cover is detachably attached to the first handle and comprises a compartment for fittingly embracing a portion of the first handle. The anti-slide cover is prevented from disengaging from the first handle by a head of the adjusting screw.

The anti-slide cover further includes a cutout in an inner lateral side thereof to allow movement of the toggle link in the cutout. The anti-slide cover may include a plurality of recesses for grasping by the fingers. The anti-slide cover further includes an end opening for receiving an end of the first handle that has a screw hole threadedly engaged with the adjusting screw.

In accordance with a second aspect of the invention, an anti-slide cover is provided for a pair of toggle operated pliers of the type including a first handle, a second handle, a toggle link pivotally connected between the first handle and the second handle, and a release lever having an end pivotally connected to the second handle by a first pin, the first pin includes two first exposed enlarged ends, the toggle link including an end pivotally connected to the second handle by a second pin, the second pin including two second exposed enlarged ends. The anti-slide cover is detachably attached to the second handle and comprises a compartment for fittingly embracing a portion of the second handle. The anti-slide cover includes two side walls each having a first depression for releasably engaging with an associated said first exposed enlarged end and a second depression for releasably engaging with an associated said second exposed enlarged end. The anti-slide cover further may include a tenon, and the second handle may include a mortise for releasably engaging with the tenon. The anti-slide cover further includes a recessed section for grasping by the thumb.

In accordance with a third aspect of the invention, an anti-slide arrangement is provided for a pair of toggle operated pliers of the type including a first handle with an adjusting screw attached thereto, a second handle, a toggle link pivotally connected between the first handle and the second handle, and a release lever having an end pivotally connected to the second handle by a first pin, the first pin including two first exposed enlarged ends, the toggle link including an end pivotally connected to the second handle by a second pin, the second pin including two second exposed enlarged ends. The anti-slide arrangement comprises:

- a first anti-slide cover detachably attached to the first handle and comprising a first compartment adapted to fittingly embrace a portion of the first handle, the first anti-slide cover being prevented from disengaging from the first handle by a head of the adjusting screw; and
- a second anti-slide cover detachably attached to the second handle and comprising a second compartment adapted to fittingly embrace a portion of the second handle, the second anti-slide cover including two side walls each having a first depression for releasably engaging with an associated said first exposed enlarged end and a second depression for releasably engaging with an associated said second exposed enlarged end.

The anti-slide covers of the present invention can be conveniently, rapidly, and detachably attached to the handles of toggle operated pliers without interfering with operation of the pliers.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
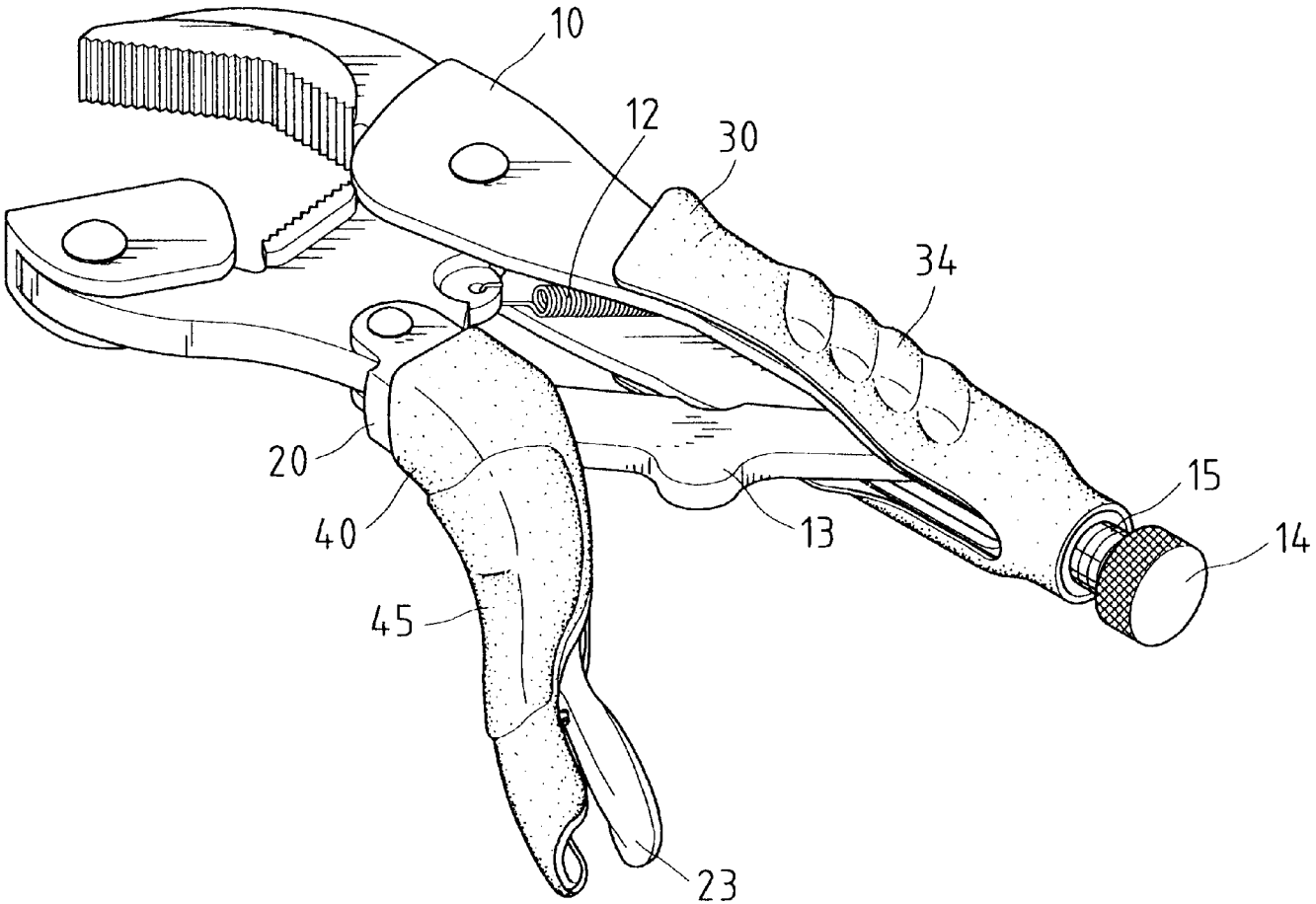
FIG. 1 is a perspective view of a pair of toggle operated pliers with anti-slide covers in accordance with the present invention.
Figure 2:
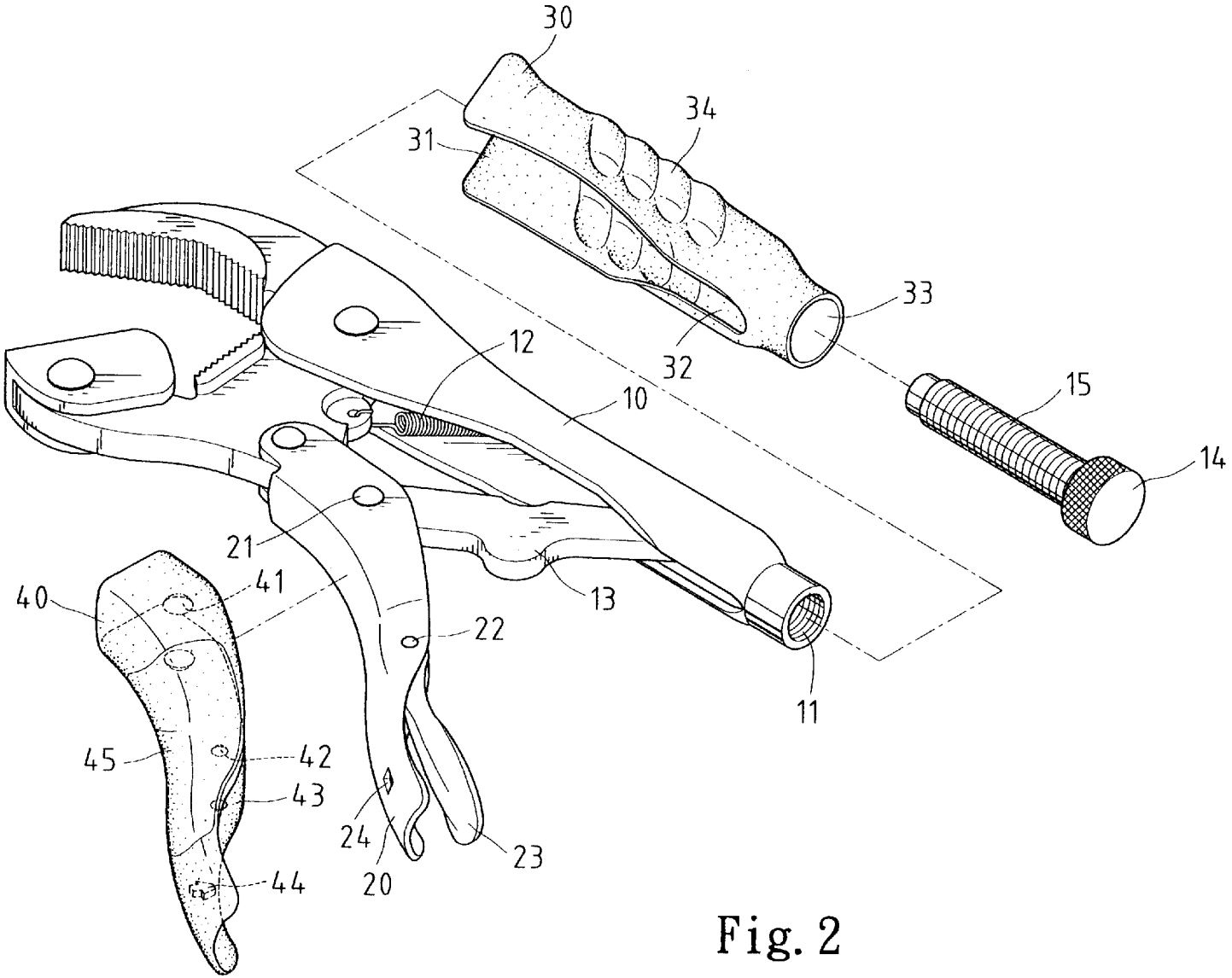
FIG. 2 is an exploded perspective view of the pair of toggle operated pliers.
Figure 3:
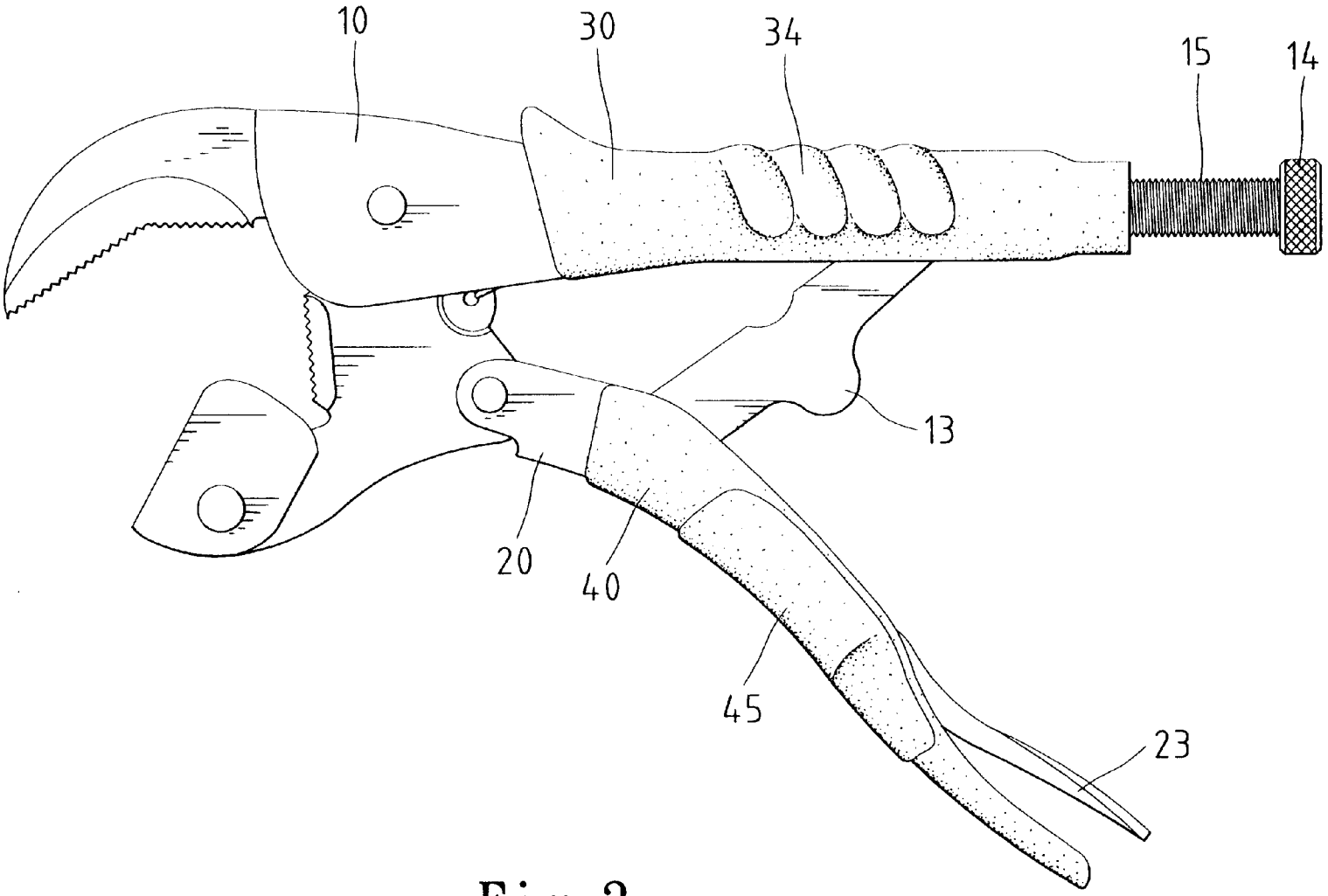
FIG. 3 is a plan view of the pair of toggle operated pliers.

Referring to FIGS. 1 through 3, a pair of toggle operated pliers generally includes a hollow first handle 10, a second hollow handle 20, a toggle link 13 pivotally connected between the handles 10 and 20, a spring 12, and a release lever 23. The first handle 10 includes a screw hole 11 in an end thereof through which a threaded stem 15 of an adjusting screw 14 extends. Structure and operation of such pliers are conventional and therefore not further described. Such hollow handles cannot be immersed in liquid bath for forming anti-slide layers, as the movable elements of the pliers, namely spring 12, toggle link 13, and release lever 23, will be adversely affected.

The present invention provides a first anti-slide cover 30 for the first handle 10 and a second anti-slide cover 40 for the second handle 20. The first anti-slide cover 30 includes a compartment 31 for fittingly embracing a portion of the first handle 10 and includes an end opening 33 that receives the end of the first handle 10 having the screw hole 11. The first anti-slide cover 30 includes a cutout 32 in an inner lateral side thereof that faces the second handle 20. The first anti-slide cover 30 further includes a plurality of recesses 34 for fingers' grasp. Movement of the toggle link 13 is not affected by the first anti-slide cover 30 due to provision of the cutout 32. In assembly, referring to FIGS. 2 and 3, the first anti-slide cover 30 is moved to a position embracing a portion of the first handle 10, and the adjusting screw 14 is then threadedly engaged with the screw hole 11 of the first handle 10 to prevent disengagement of the first anti-slide cover 30, as the head of the adjusting screw 14 is larger than opening 33 in the end of the cover first anti-slide 30. Detachment of the first anti-slide cover 30 can be easily achieved after disengaging the adjusting screw 14 from the first handle 10.

The second anti-slide cover 40 includes a compartment 43 defined by two side walls thereof for fittingly embracing a portion of the second handle 20. Each side wall of the second anti-slide cover 40 includes two depressions 41 and 42. The depression 41 is sized to fittingly receive an exposed enlarged end 21 of a pin (not shown) that pivotally connects an end of the toggle link 13 with the second handle 20. The depression 42 is sized to fittingly receive an exposed enlarged end 22 of a pin (not shown) that pivotally connects an end of the lever 23 with the second handle 20. In addition, the second anti-slide cover 40 includes a tenon 44 for releasably engaging with a mortise 24 in the second handle 20. Thus, the second anti-slide cover 40 can be easily, quickly, and detachably attached to the second handle 20 without interfering with operation of the second handle 20. The second anti-slide cover 40 further includes a recessed section 45 for thumb's grasp.

According to the above description, it is appreciated that the anti-slide covers of the present invention can be conveniently, rapidly, and detachably attached to the handles of toggle operated pliers without interfering with operation of the pliers.

Although the invention has been explained in relation to its preferred embodiment, it is to be understood that many other possible modifications and variations can be made without departing from the spirit and scope of the invention as hereinafter claimed.

What is claimed is:

1. An anti-slide cover for a pair of toggle operated pliers of the type including a first handle, a second handle, a toggle link pivotally connected between the first handle and the second handle, and a release lever having an end pivotally connected to the second handle by a first pin, the first pin including two first exposed enlarged ends, the toggle link including an end pivotally connected to the second handle by a second pin, the second pin including two second exposed enlarged ends, the anti-slide cover being detachably attached to the second handle and comprising a compartment adapted to fittingly embrace a portion of the second handle, the compartment being U-shaped and including two side walls extending from an interconnecting wall, each side wall having a first depression for releasably engaging with an associated said first exposed enlarged end and a second depression for releasably engaging with an associated said second exposed enlarged end, with the first and second depressions being formed exclusively in the side walls.

2. The anti-slide cover as claimed in claim 1, wherein the anti-slide cover further includes a tenon and wherein the second handle includes a mortise for releasably engaging with the tenon.

3. The anti-slide cover as claimed in claim 1, wherein the anti-slide cover further includes a recessed section for thumb's grasp.

4. Tool comprising, in combination:

a toggle operated pliers comprising a first handle having an end with an adjusting screw attached thereto, a second handle, and a toggle link pivotally connected between the first handle and the second handle, with the adjusting screw having a head; and an anti-slide cover detachably attached to the first handle and comprising a compartment adapted to fittingly embrace a portion of the first handle, and means abutting with the head of the adjusting screw for preventing the compartment from disengaging from the first handle.

5. The tool as claimed in claim 4, wherein the anti-slide cover further includes a cutout in an inner lateral side of the compartment to allow movement of the toggle link in the cutout.

6. The tool as claimed in claim 4, wherein the preventing means comprises an end opening formed in the compartment adapted to receive the end of the first handle.

7. Tool comprising, in combination:

a toggle operated pliers comprising a first handle, a second handle, a toggle link pivotally connected between the first handle and the second handle, and a release lever having an end pivotally connected to the second handle by a first pin, the first pin including two first exposed enlarged ends, the toggle link including an end pivotally connected to the second handle by a second pin, the second pin including two second exposed enlarged ends; and an anti-slide cover detachably attached to the second handle and comprising a compartment adapted to a fittingly embrace a portion of the second handle, the compartment including two side walls each having a first depression for releasably engaging with an associated first exposed enlarged end and a second depression for releasably engaging with an associated said second exposed enlarged end.

8. The tool as claimed in claim 7, wherein the anti-slide cover further includes a tenon and wherein the second handle includes a mortise for releasably engaging with the tenon.

* * * * *